US006824223B2

(12) United States Patent
Davidovic

(10) Patent No.: US 6,824,223 B2
(45) Date of Patent: Nov. 30, 2004

(54) UTILITY CART UNLOADING SYSTEM

(75) Inventor: Slobodan Davidovic, Weymouth, MA (US)

(73) Assignee: EZ Lift Backsaver, Inc., Medway, MA (US)

( * ) Notice: Subject to any disclaimer, the term of this patent is extended or adjusted under 35 U.S.C. 154(b) by 1 day.

(21) Appl. No.: 10/170,844

(22) Filed: Jun. 13, 2002

(65) Prior Publication Data

US 2003/0230924 A1 Dec. 18, 2003

(51) Int. Cl.[7] ..... B60P 1/00
(52) U.S. Cl. ..... 298/1 B
(58) Field of Search ..... 298/1 B, 1 A, 298/2; 414/304, 325, 404, 518, 545, 556

(56) References Cited

U.S. PATENT DOCUMENTS 1,805,489 A * 5/1931 Kerr et al.
2,584,025 A * 1/1952 Kelsey
3,870,367 A * 3/1975 O'Brien ..... 298/1 B
4,034,880 A * 7/1977 Frenette
4,314,788 A * 2/1982 Williams et al.
4,601,631 A * 7/1986 Van Raaij
4,629,390 A * 12/1986 Burke
4,917,558 A * 4/1990 Jenkins
5,228,750 A * 7/1993 Hagenbuch ..... 298/1 B
5,312,162 A * 5/1994 Baebel ..... 298/1 B
5,520,496 A * 5/1996 Podd, Jr. et al.

* cited by examiner

*Primary Examiner*—Stephen Gordon
(74) *Attorney, Agent, or Firm*—Fish & Richardson P.C.

(57) ABSTRACT

A utility cart unloading system that is both functional and necessary. A canvas sling is attached to a steel tube which is installed into a frame that fits on the top rim of a cart. Rotation clockwise/counterclockwise of the steel tube is provided by an electrical tubular motor and controlled by a rocker switch. Lifting of the contents of a cart is provided by winding one side of a canvas sling around the steel tube. The other side of the canvas sling is attached to the frame opposite the steel tube.

21 Claims, 3 Drawing Sheets

UTILITY CART UNLOADING SYSTEM

FIELD OF THE INVENTION

The present invention relates to utility carts and, more particularly, to dry cleaning/laundry carts that automatically—on demand lift the contents to a waist-high level.

BACKGROUND OF THE INVENTION

Ever since utility carts (baskets) were invented and put to use, there has been a need to unload them. A functional and easy to use unloading system was desired by the operators from the earliest days of use of the carts. However, in the early days the carts were not used as frequently and their occasional unloading was not considered a serious problem. Only in the last few decades due to widespread use of carts in the service industry such as dry cleaning, laundry and hospitality, back injury problems were realized and acknowledged, and the need for a solution increased dramatically. For example the Government of the United States through OSHA has issued ergonomic guidelines and regulations addressing bending and lifting in the workplace. Again, as a result of the increased stress and an ever-demanding work load, workers are increasingly forced to unload utility carts on an average of 15 to 20 times a day, multiplied by the number of items in the carts. Therefore, the need for a device to help unload utility carts is clear and critical.

One device available today that is used to help unload utility carts is a spring-loaded platform. The platform is a canvas wrapped steel frame that hangs inside a cart with four to six springs attached to the top rim of the cart. The load itself, if it is heavy enough, expands the springs and allows the platform to move down to the bottom. As one unloads the cart the springs lift the platform, therefore helping an operator reach the items in the cart. Normally the platform stops midway in the cart due to the length of the springs.

Another unloading system stationary steel tank with a mesh material sling inside, which travels to the bottom/bare floor. Wet clothes are dumped from a conveyer into the tank and the sling is made to raise the clothes for unloading by rolling up around a long thin rollers permanently connected to the back wall of the tank. The roller is powered by a large industrial motor, four foot long chain, and industrial gearbox controlled by a floor mounted foot pedal switch.

U.S. Pat. No. 3,870,367 by O'Brien describes a hand propelled loading cart utilizing a flexible load release sheet that is used to damp bulk loads.

It is therefore an object of the invention to help with the unloading of utility carts It is another object of the invention to eliminate back injuries It is another object of the invention to eliminate back, arm, shoulder, leg and neck strain.

It is another object of the invention to eliminate blood pressure to the head caused by bending over.

It is another object of the invention to completely eliminate the need to bend while reaching for items on the bottom of a cart.

It is another object of the invention to increase worker productivity by speeding up the unloading and sorting of items coming out of the cart.

SUMMARY OF THE INVENTION

In accordance with the present invention, there is provided a utility cart unloading system that is both functional and necessary. The system includes a canvas sling that is attached to a steel tube which is then installed into a metal frame that fits onto the top rim of a cart. A electrical tubular motor rotates the steel tube clockwise and counterclockwise, the motor is controled by rocker switch. By winding one side of the canvas sling around the steel tube, the contents of the cart are lifted. The other side of the sling is attached to the frame on the opposite side of the steel tube.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Generally speaking, the invention pertains to a utility cart 36 unloading system that helps with the unloading of utility carts, in order to prevent bending to reach items on the bottom of a cart 36 thus preventing back injuries.

Figure 1:
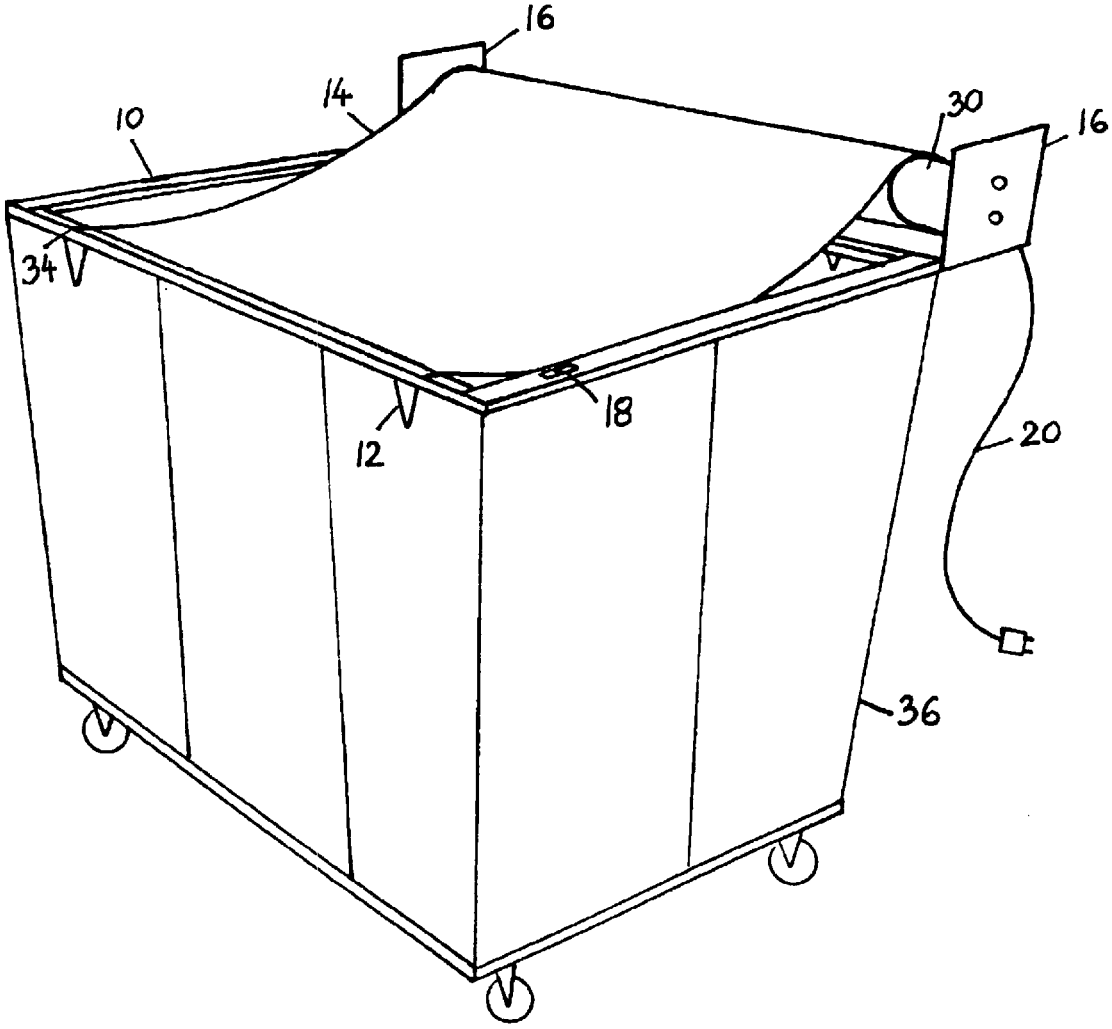
FIG. 1 is a perspective view of an utility cart unloading system in accordance with the invention.

FIG. 1, illustrates the utility cart 36 unloading system of this invention is illustrated. The utility cart 36 unloading system includes a poweraxle, a sling 14, an electrical switch 18 and a metal frame 10.

Figure 2:
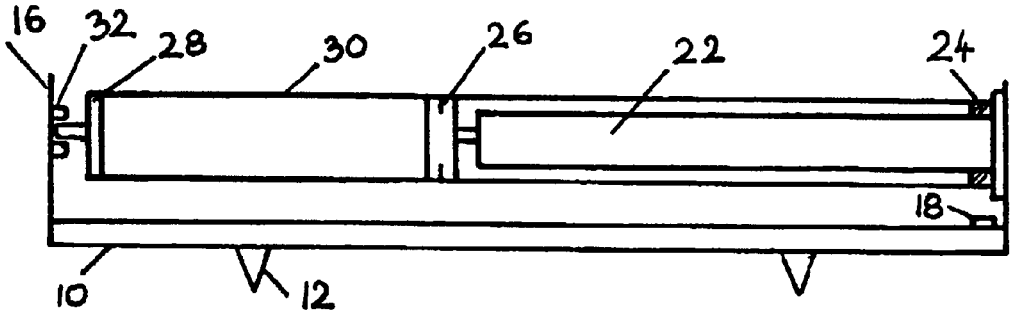
FIG. 2 is a cross sectional view of an assambled poweraxle, used in the utility cart unloading system of the invention.
Figure 3:
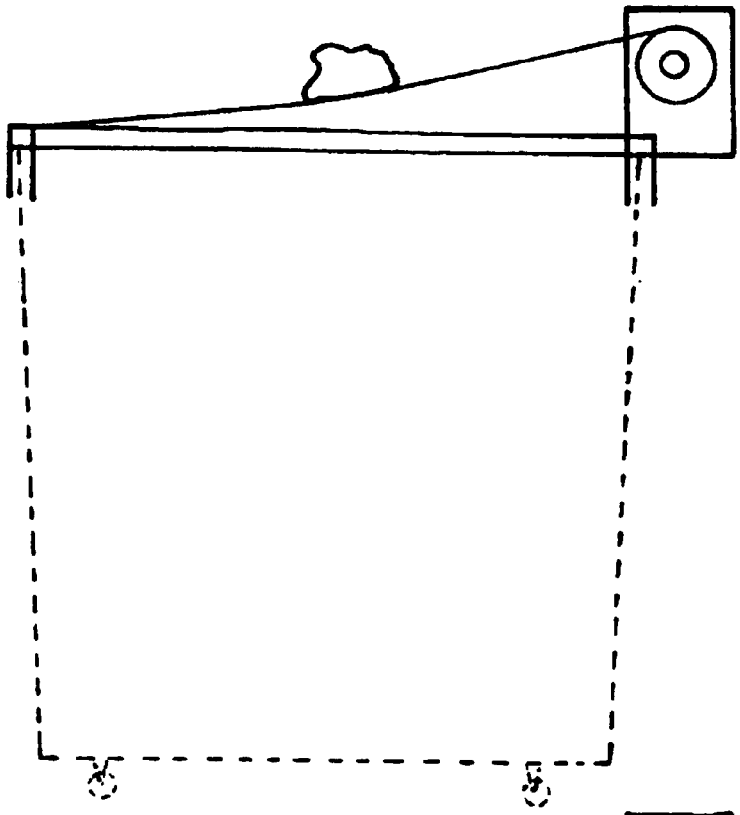
FIG. 3 is a cross sectional view of an utility cart unloading system in use in the "UP" position, when the unloading is completed and the cart is empty.
Figure 4:
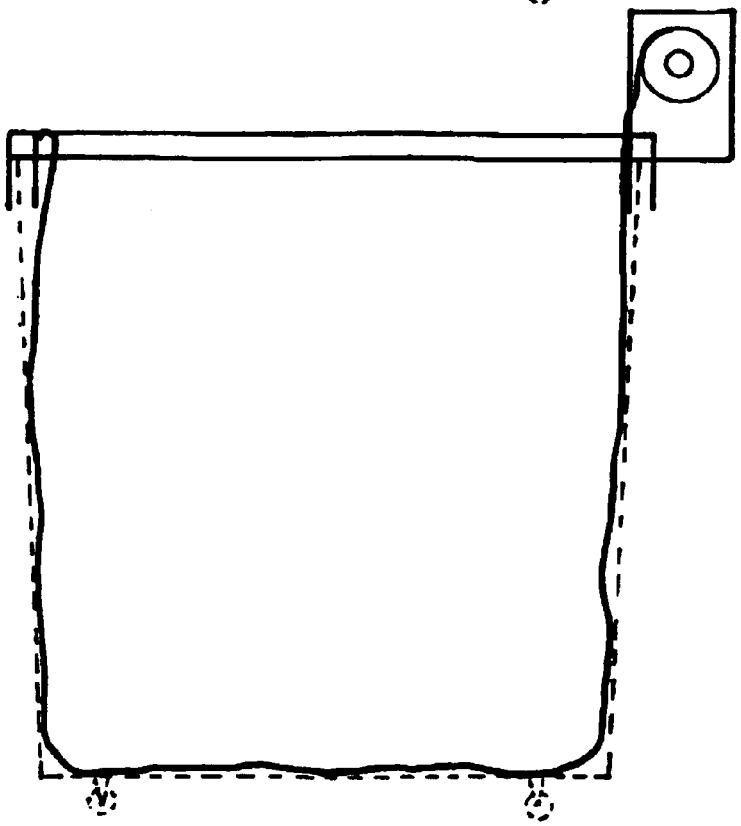
FIG. 4 is a cross sectional view of an utility cart unloading system in use in the "DOWN" position, and the cart is ready for loading.

The metal frame 10 is used to serve as a superstructure for the parts and can be made of steel or aluminum and can fit different sizes of carts to provide flexibility in moving the utility cart 36 unloading system from one cart 36 to another. It has two guidelocks 12 in the front of the frame 10 and two in the back so it can sit securely on the top rim of a cart 36 frame 10. Also two brackets 16 on the back of the frame 10 are securely attached in the corners, as shown in FIG. 2 as to provide support for the power axle. The brackets 16 can be welded or bolted to the frame 10. The side of the frame 10, which is perpendicular to the power axle, is where an electrical switch 18 is mounted, which can be on the left or right side and is made of a hollow square tube 30, which accommodates an electrical switch 18 and electrical tubular motor 22. The electrical switch 18 is flush mounted in the frame 10 and is located opposite the power axle. The power axle is installed between the brackets 16 with two ¼" bolts on each side. A heavy duty canvas sling 14 is formed by attaching one edge of a piece of canvas to the power axle and securing the opposite edge of the canvas side of the frame 10 opposite to the power axle as shown in FIG. 1. The powe raxle is detailed in FIG. 2 and includes an electrical tubular motor 22 with crown 24, drive 26 and idler 28 inserted inside a steel tube 30. On one side of the tube 30 is a motor head which is attached to the bracket with two bolts, also on the same side is a crown 24 which is basically a bushing that provides the motor to fit into different size steel tubes and also for the steel tube 30 to rotate around the electrical tubular motor 22. On the other side of the electrical tubular motor 22 is a drive 26. The drive 26 is a crown mounted on the motor shaft and attached to the steel tube 30 to provide rotation of the tube 30 and also to secure the positioning of the electrical tubular motor 22 inside the steel tube 30. On the opposite side of the steel tube 30 is an idler 28, which is a plug with a small metal shaft to fit different sizes of steel tube 30 and to provide a rotational connection with a self-aligning bearing 32 attached to the bracket by two bolts. The crown 24, drive 26 and idler 28 can be made of cast aluminum or hard plastic—depending on the size and torque of the electrical tubular motor 22.

In operation the Utility Cart 36 Unloading System is foolproof. The frame 10, as shown in FIG. 1 serves as a base for the elements of the utility cart 36 unloading system providing portability and can be made in different sizes to fit any existing or new carts in the market. The frame 10 gives the utility cart 36 unloading system the usability and look of a finished product which is ready for use on all existing carts—simply plug in and go. The guidelocks 12 on the bottom of the frame 10 provide a safe and secure fit on the top rim of the cart 36, wherein it improves the stability of the canvas/steel frame 10 carts. A hollow square tube 30 with a slot for an electrical switch 18, that serves as a part of the frame 10, provides space for an electrical switch 18 to be mounted flush, so as to not to be an obstacle for the contents of the cart 36. One cable is a power electrical cord 20 with a three pronged plug for 115V, 10A electrical power and the other is a four wire electrical cord 20 from the electrical tubular motor 22. The electrical switch 18 is positioned on the opposite side of the power axle, ergonomically close to an operator and has two positions—up and down. It serves to control the travel of the sling 14 up or down and as a safety device. An operator must keep a finger on the switch at all times during the travel of the sling 14 and he/she controls precisely how long that travel will be—depending on the need. This means that he/she will not be rushed by the system and they can choose their own working pace.

Unloading the cart 36 requires the sling 14 to travel up, in increments of a few seconds, to allow an operator to pick out items and sort them on a hanging rack or a table. Once the unloading is done an operator needs to lower the sling 14 to the bottom of the cart 36 to allow the cart 36 to be loaded again. That will be achieved by pressing the electrical switch 18 and maintaining it until the sling 14 settles on the bottom of the cart 36 allowing contents to fill the cart 36 to its full capacity. Both travels (up or down) are preset and controlled by limit switch built into the electrical tubular motor 22. This prevents any possible damage to the canvas sling 14 or the contents of the cart 36 caused by overtravel of the sling 14 and provides the exact positioning of the sling 14 every time the utility cart 36 unloading system is used. The travel of the sling 14 is provided by a poweraxle which provides clockwise/counterclockwise controlled rotations of the steel tube 30, thus enabling the sling 14 to wind/unwind around the steel tube 30 and as a result, lifting contents of the cart 36 to a waist-high level. The power axle is an assembly that provides the rotation of the steel tube 30.

The electrical tubular motor 22 is equipped with built-in limit switches and a brake. Once you determine the size of the steel tube 30, depending on the size of the cart 36, you then choose the size of an electrical tubular motor 22 and crown 24, drive 26 and idler 28 that will fit the chosen steel tube 30. Crown 24 (bushing) will slide over the body of the tubular motor and sit on the motor head side. Drive 26 will fit on the motor shaft and once the electrical tubular motor 22 is inserted inside the steel tube 30, it will be secured from the outside to the steel tube 30. This will enable the rotations of the motor shaft to be transferred to the steel tube 30 and it will be controlled by the electrical tubular motor 22 and ultimately the electrical switch 18. The proper width of canvas will be attached to the steel tube 30 and the other side of the canvas will be attached to the opposite side of the frame 10. This way the canvas will form a lifting sling 14. The length of canvas will be determined by the depth of the cart 36 (basically by the size of the cart 36).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A portable cart unloading device comprising:

a frame comprising a front end and a back end and being configured to be removably attached to a top edge of a utility cart;

a hollow tube rotatably secured to the back end of the frame;

a flexible sling having a front edge and a back edge, wherein the front edge is secured to the front end of the frame and the back edge is secured to the hollow tube, such that the sling is rolled up on the hollow tube when the tube is rotated;

a tubular motor arranged within the hollow tube and connected at one end to the frame and comprises a shaft rigidly connected to the hollow tube to rotate the hollow tube; and a switch wired to the tubular motor to control rotation of the hollow tube;

wherein the sling has a length from the front edge to the back edge that permits the sling to line the utility cart when completely unrolled, and to span a distance between the front and back ends of the frame when completely rolled up on the hollow tube.

2. The device of claim 1, wherein the sling comprises canvas.

3. The device of claim 1, wherein the frame and hollow tube comprises metal.

4. The device of claim 1, wherein the switch controls clockwise and counterclockwise rotation of the hollow tube.

5. The device of claim 1, wherein the frame comprises guide locks to secure the frame to the top edge of the utility cart.

6. The device of claim 1, wherein the hollow tube is rotatably connected to the back end of the frame by a bracket at one end, and the tubular motor at the other.

7. The device of claim 1, wherein the tubular motor comprises a rotating shaft extending from a central axis of the motor, and a crown rigidly connected at a central point to the shaft and attached to the inside of the hollow tube, wherein rotation of the shaft causes rotation of the crown and the hollow tube.

8. The device of claim 1, further comprising a cylindrical idler that fits into the hollow tube and comprises a shaft arranged to rest in a bracket connected to the frame.

9. The device of claim 8, wherein the bracket comprises a bearing which rotatably holds the shaft of the idler into the bracket.

10. The device of claim 1, wherein the switch is a rocker switch to control rotation of the hollow tube, and further wherein the switch automatically stops the motor when released.

11. The device of claim 1, wherein the motor comprises a limit switch to stop rotation once the sling is fully wound or unwound from the hollow tube.

12. The device of claim 1, further comprising a crown that fits into the hollow tube to enable the hollow tube to rotate about the tubular motor within the hollow tube.

13. A portable automatically unloading utility cart system comprising:

a utility cart having a front wall, a back wall, and two side walls connecting the front and back walls;

a hollow tube rotatably secured to the back wall;

a flexible sling having a front edge and a back edge, wherein the front edge is secured to the front wall of the utility cart and the back edge is secured to the hollow tube, such that the sling is rolled upon the hollow tube when the tube is rotated;

a tubular motor arranged within the hollow tube and connected at one end to the back or side wall of the utility cart and comprises a shaft rigidly connected to the hollow tube to rotate the hollow tube; and a switch wired to the tubular motor to control rotation of the hollow tube;

wherein the sling has a length from the front edge to the back edge that permits the sling to line the utility cart when completely unrolled, and to span a distance between the front and back walls of the cart when completely rolled up on the hollow tube.

14. The system of claim 13, further comprising a frame that is configured to rest securely on top of the walls of the utility cart.

15. The system of claim 13, wherein the switch controls clockwise and counterclockwise rotation of the hollow tube.

16. The system of claim 13, wherein the tubular motor comprises a rotating shaft extending from a central axis of the motor, and a crown rigidly connected at a central point to the shaft and attached to the inside of the hollow tube, wherein rotation of the shaft causes rotation of the crown and the hollow tube.

17. The system of claim 13, further comprising a cylindrical idler that fits into the hollow tube and comprises a shaft arranged to rest in a bracket connected to the frame.

18. The system of claim 13, wherein the switch is a rocker switch to control rotation of the hollow tube, and automatically stops the motor when released.

19. The system of claim 13, wherein the motor comprises a limit switch to stop wound or unwound from the hollow tube.

20. The system of claim 13, further comprising a crown that fits into the hollow tube to enable the hollow tube to rotate about the tubular motor within the hollow tube.

21. The device of claim 1, wherein the frame comprises steel.

* * * * *